US010190313B1

(12) United States Patent
Toledo

(10) Patent No.: US 10,190,313 B1
(45) Date of Patent: Jan. 29, 2019

(54) CONSTRUCTION BLOCK SYSTEM

(71) Applicant: Omar Toledo, Miami, FL (US)

(72) Inventor: Omar Toledo, Miami, FL (US)

( * ) Notice: Subject to any disclaimer, the term of this patent is extended or adjusted under 35 U.S.C. 154(b) by 0 days.

(21) Appl. No.: 15/923,452

(22) Filed: Mar. 16, 2018

(51) Int. Cl.

| | |
|---|---|
| ***E04B 2/16*** | (2006.01) |
| ***E04C 1/39*** | (2006.01) |
| ***E04G 21/18*** | (2006.01) |
| ***E04B 2/46*** | (2006.01) |
| ***E04B 2/32*** | (2006.01) |
| ***E04B 2/54*** | (2006.01) |
| *E04B 2/02* | (2006.01) |

(52) U.S. Cl.
CPC ..... *E04B 2/16* (2013.01); *E04B 2/32* (2013.01); *E04B 2/46* (2013.01); *E04B 2/54* (2013.01); *E04C 1/39* (2013.01); *E04G 21/18* (2013.01); *E04B 2002/0202* (2013.01); *E04B 2002/0243* (2013.01); *E04B 2002/0247* (2013.01); *E04B 2002/0278* (2013.01)

(58) Field of Classification Search
CPC ..... E04B 2/16; E04B 2002/0278; E04B 2002/0247; E04B 2002/0243; E04B 2002/0202; E04B 2/46; E04B 2/54; E04B 2/32; E04G 21/18
See application file for complete search history.

(56) References Cited

U.S. PATENT DOCUMENTS

| | | | | |
|---|---|---|---|---|
| 3,529,390 A * | 9/1970 | Stetter | E04B 2/18 52/285.1 |
| 5,193,320 A * | 3/1993 | Coccagna | E04B 2/10 52/442 |
| 6,082,067 A | 7/2000 | Bott | |
| 6,138,426 A * | 10/2000 | Mork | E04B 1/703 52/293.2 |
| 6,763,644 B1 * | 7/2004 | Toledo | E04B 2/14 52/592.6 |

(Continued)

FOREIGN PATENT DOCUMENTS

| | | | |
|---|---|---|---|
| DE | 2739017 A1 * | 3/1979 | E04B 2/08 |
| FR | 2396134 A1 * | 1/1979 | E04B 2/16 |

(Continued)

*Primary Examiner* — Adriana Figueroa
(74) *Attorney, Agent, or Firm* — Sanchelima & Associates, P.A.; Jesus Sanchelima; Christian Sanchelima

(57) ABSTRACT

A construction block system including primary blocks 15, primary half blocks 115, base blocks 215, base half blocks 315 and column blocks 415 that cooperate to erect vertical structures using leveling and alignment tools at the base and between rows of blocks. Alignment and leveling tool 80 permits the leveling of the first row with respect to a supporting surface S and also immobilizes tool 80. The longitudinal outer walls 20; 40; 120; 140; 220; 240; 320; 340; 420 and 440 include outwardly extending rectangular walls 25; 45; 125; 145; 225; 245; 325; 345; 425; and 445 that coact with each other leave a space between abutting blocks for cementitious substances to further bind the structure. Tool 80 rests on surface S and includes two parallel rails receivable within cooperating and aligned channels on the base and column blocks. Tools 80 includes an elongated rigid member receivable within abutting blocks horizontal surfaces and serves to align and strengthen the structure.

5 Claims, 17 Drawing Sheets

(56) References Cited

U.S. PATENT DOCUMENTS

| | | | | |
|---|---|---|---|---|
| 7,461,490 | B2 * | 12/2008 | Toledo | E04B 2/14 52/293.2 |
| 7,762,033 | B2 * | 7/2010 | Scott | E04B 2/06 52/274 |
| 9,086,268 | B2 * | 7/2015 | Jones | E04B 2/18 |
| 2007/0119115 | A1 * | 5/2007 | Negron Crespo | E04B 2/54 52/596 |

FOREIGN PATENT DOCUMENTS

| | | | | |
|---|---|---|---|---|
| GB | 2497537 | A * | 6/2013 | E04B 2/16 |
| WO | WO-2017183967 | A1 * | 10/2017 | E04B 2/08 |

* cited by examiner

CONSTRUCTION BLOCK SYSTEM

BACKGROUND OF THE INVENTION

1. Field of the Invention

The present invention relates to a construction block system and accessories, and more particularly, to a construction block system that can be readily aligned during installation with predictable dimensions for the resulting structure.

2. Description of the Related Art

Many designs for construction block systems have been designed in the past. None of them, however, includes a mechanism for keeping the base block separated from the supporting surface (typically a foundation) to permit cementitious substances to be uniformly lodged therein. The configuration of the base and basic blocks also include projected walls on the outer surfaces that coact with abutting blocks to provide additional spaces to lodge cementitious material and this is not possible with the conventional concrete blocks of the prior art. Lastly, the channels used for alignment on the upper and lower edge walls are positioned off-center a predetermined distance to allow reinforcing bars and other conducts to pass through.

Applicant believes that a related reference corresponds to U.S. Pat. No. 6,082,067 issued to Tim Allen Bott on Jul. 4, 2000 for dry stackable block structures. Bott's stackable block structure system for dry stacking concrete reinforced walls, includes a stretcher block with a recess of triangular cross-section on the bottom surface and disposed intermediate a pair of co-planar, parallelly disposed laterally extending rectangular edge portions. The top surface of the block includes a flat portion in the center and two edge portions forming upwardly converging surfaces of truncated triangular cross-section. Notches (33; 34 and 35) are disposed at a midpoint of the webs (31; 32 and 30, respectively) and have a semi-circular cross sectional configuration to receive a horizontally disposed reinforcing bar are provided to allow concrete to engage the rebar at the ends of the block structure. However, even if the Bott's patent mentions that "horizontally disposed reinforcing rods may be positioned between courses and received in notches 33-35", it does not disclose a system as claimed herein. The separations between abutting blocks are also created when cement is applied.

None of the prior art blocks includes external horizontal edge cutouts to receive the cement to avoid the creation of separations between abutting blocks and upper and lower channels. Also, the present invention includes the use of block aligning accessories, such as the base alignment tool and row leveling and reinforcement tool cooperative received by the block lower and upper channels, to permit a user to keep a wall structure aligned throughout its construction. These features are not suggested in the prior art references.

Applicant believes that another related reference corresponds to U.S. Pat. No. 6,763,644 issued to Omar Toledo for Construction Block System. However, it differs from the present invention because the projected walls providing for lodging additional cementitious material are slanted thus not holding sufficient binding material. Also, an important drawback of patent '644 is overcome with the present invention. In the patented block system sheet 82 did not allow the cementitious material to come in contact with the bottom surface of the base block. Like the other systems in the prior art, the '644 patent fails to disclose any means for lifting the base block to permit the uniform placement of cementitious material and the alignment channels pass through the center of the blocks thereby interfering with the reinforcement bars and other construction conduits.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a construction block system that allows a user to readily align and level contiguous blocks without separation in-between to form wall structures and simultaneously permit the bottom surfaces of the base blocks to come in contact with the cementitious material.

It is another object of this invention to provide a block system that includes external rectangular walls, smaller than the longitudinal walls that cooperate with abutting block's similar rectangular walls for receiving cement without creating a separation between abutting blocks.

Another object of this invention is to provide a block system that includes pair of channels in the upper and lower transversal walls to receive aligning and leveling tools.

It is still another object of this invention to provide a block system that allows a user to readily build wall structures with consequent savings of time.

It is still another object of this invention to provide a block system that can be readily assembled and disassembled without requiring specialized tools or substantial previous training or experience.

It is yet another object of this invention to provide such a system that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
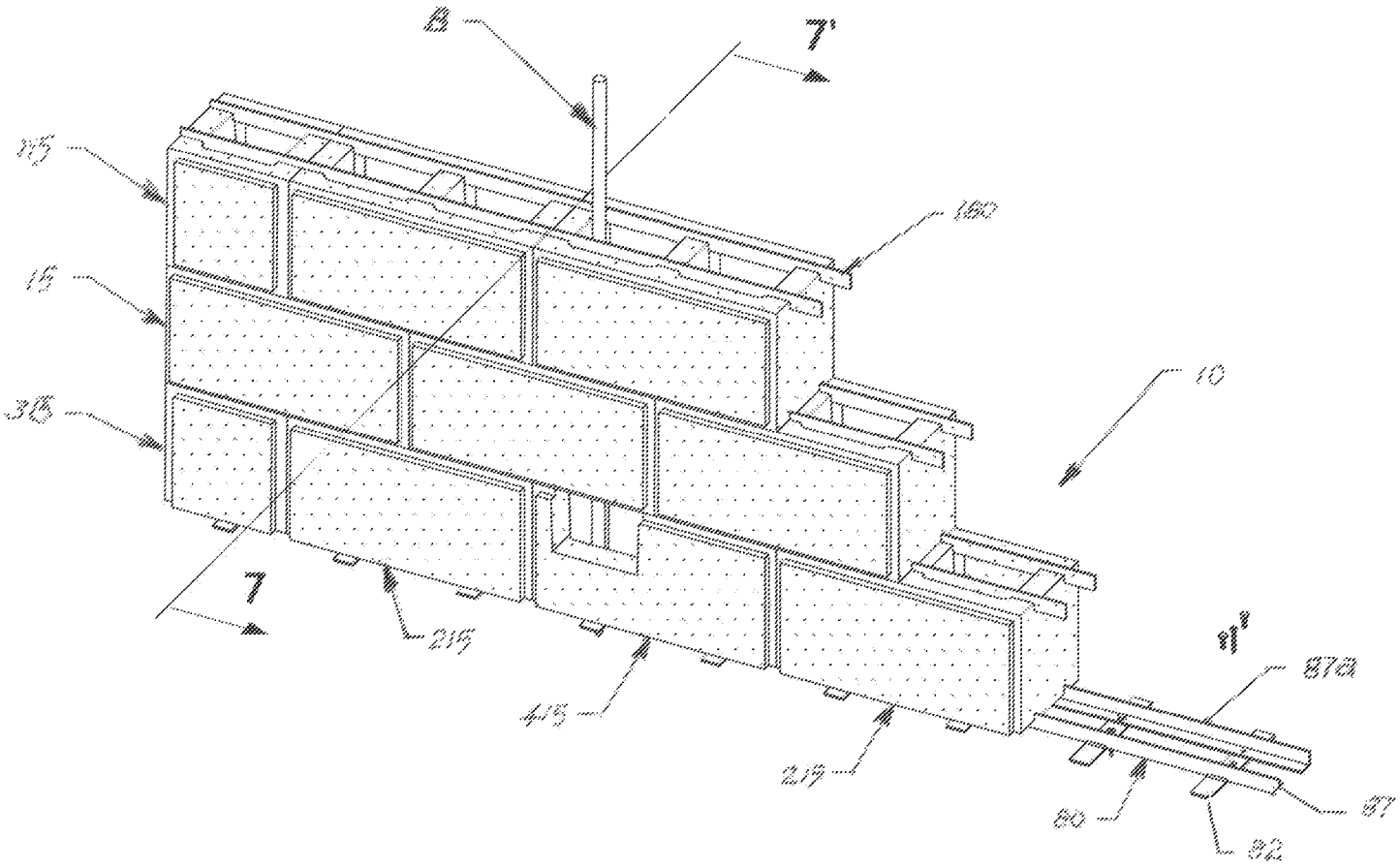
FIG. 1 is an isometric view of a wall structure being built using the present invention where the first row of blocks is placed on the base alignment assembly and the row leveling and reinforcement assembly is mounted on contiguous subsequent rows.
Figure 1A:
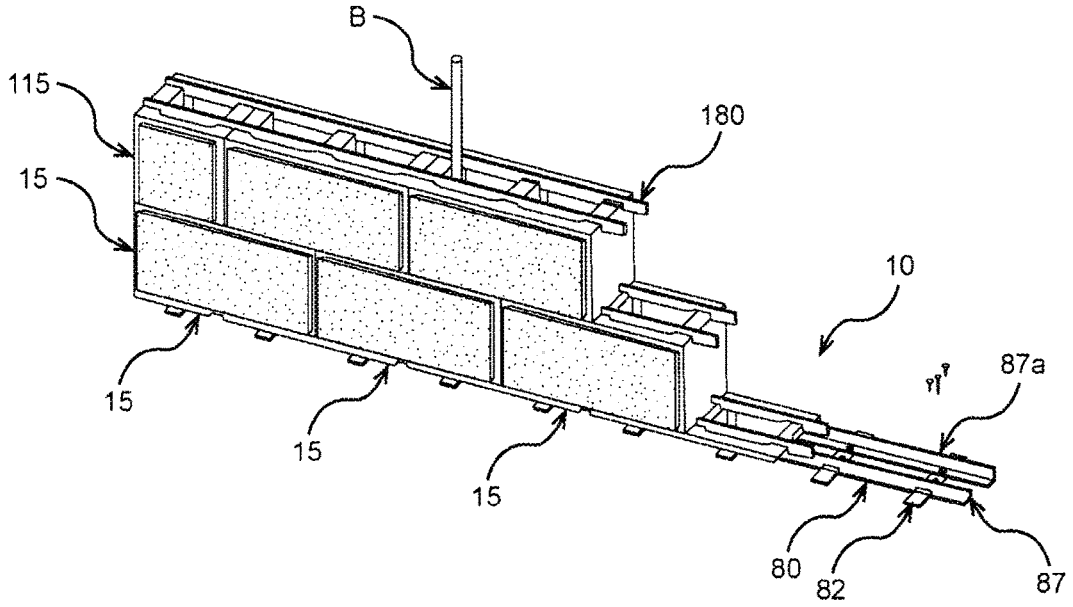
FIG. 1A is an isometric view of a wall structure being built using the present invention where a first row of primary blocks and primary half blocks is placed on the base alignment assembly and the row leveling and reinforcement assembly is mounted on contiguous subsequent rows.

Referring now to the drawings, where the present invention is generally referred to with numeral 10, it can be observed that it basically includes primary blocks 15, primary half blocks 115, base blocks 215, base half blocks 315 and base column blocks 415. With these five types of blocks, all vertical structures can be built. As best seen in FIG. 1, these blocks cooperate with each other to form vertical structures and also with the alignment and level tool 80 and alignment tool 100.

Figure 2:
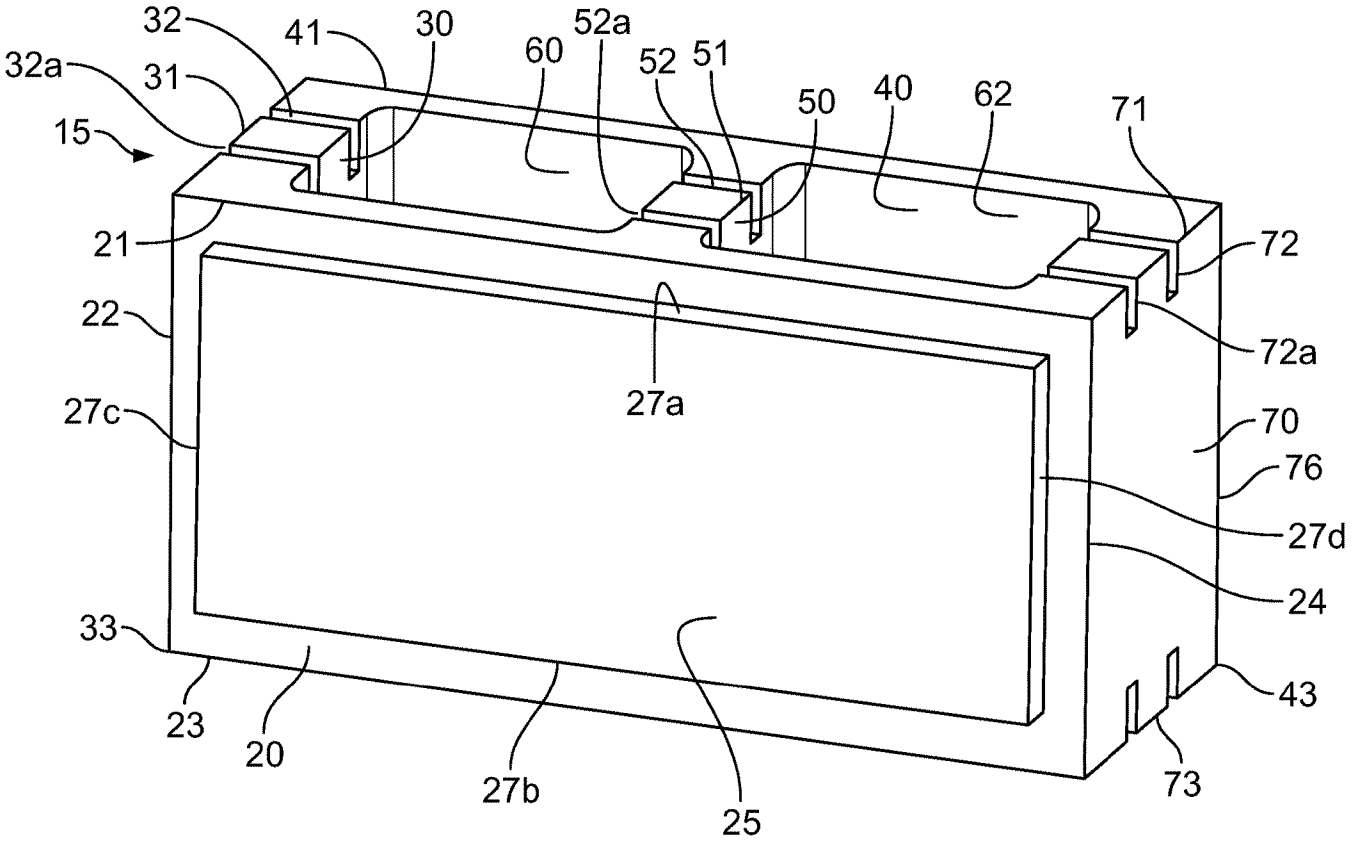
FIG. 2 represents an isometric view of one of the preferred embodiments for the construction primary or base block, used in the system object of the present application.
Figure 2A:
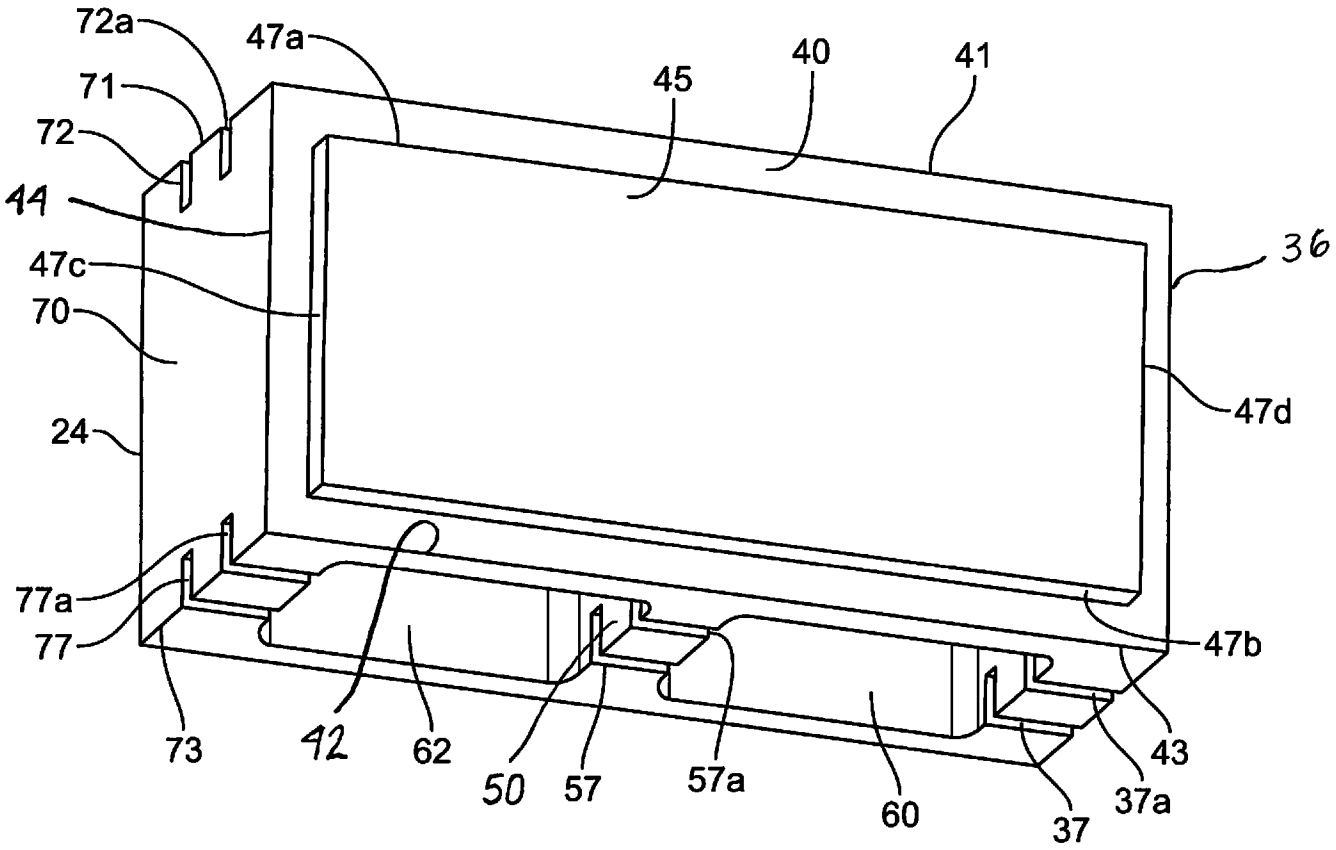
FIG. 2A represents an isometric view of the primary block in FIG. 2 as seen from below.

As best seen in FIGS. 2 and 2A, primary block 15 includes longitudinal walls 20; 40; transversal walls 30; 50 and 70. Transversal wall 30 has wall ends 31 and 33. Transversal wall 50 has wall ends 51 and 53. Transversal wall 70 has wall ends 71 and 73. Longitudinal walls 20 and 40 are disposed at a parallel and spaced apart relationship with respect to each other and perpendicularly with respect to transversal walls 30, 50 and 70.

Walls 20; 30; 40; 50 and 70 define internal cavities 60 (between walls 30 and 50) and cavity 62 (between walls 50 and 70). Block 15 also includes longitudinal upper edges 21 and 41 of longitudinal walls 20 and 40, respectively. Walls 20 and 40 include side edges 22 and 24 for wall 20 and side edges 36 and 76 for wall 40 that extend perpendicularly from upper edge 21 and lower edge 23, upper edge 41 and lower edge 43, respectively.

Rectangular wall 25 is mounted to, or integrally extends from wall 20 outwardly. Wall 25 is smaller than wall 20 and includes peripheral edge walls 27*a*; 27*b*; 27*c* and 27*d* that are positioned inwardly a predetermined distance from upper edges 21; side edge 22; lower edge 23 and side edge 24, respectively.

Similarly, rectangular wall 45 is mounted to or integrally extends from, wall 40 outwardly. Wall 45 is smaller than wall 40 and includes peripheral edge walls 47*a*; 47*b*; 47*c* 47*d* that are positioned inwardly predetermined distances from upper edge 41; side edge 42; lower edge 43; and side edge 44, respectively.

As seen in FIG. 2, transversal walls 30; 50 and 70 include upper channels 32; 32*a*; 52; 52*a*; 72 and 72*a*, and lower channels 37; 37*a*; 57; 57*a*; 77 and 77*a*, respectively, that are aligned with each other and preferably positioned off center, at predetermined distance from wall 20 or wall 40. This distance is preferably between 10% and 30% of the width of cavities 60 or 62 (which are preferably of equal width). This separation prevents the interference of tools 80 and 180 with reinforcement bars B or conduits used in these structures. The width of channels 32; 32*a*; 52 and 52*a* is such that they snuggly receive guiding tools 80 and 180.

Figure 3:
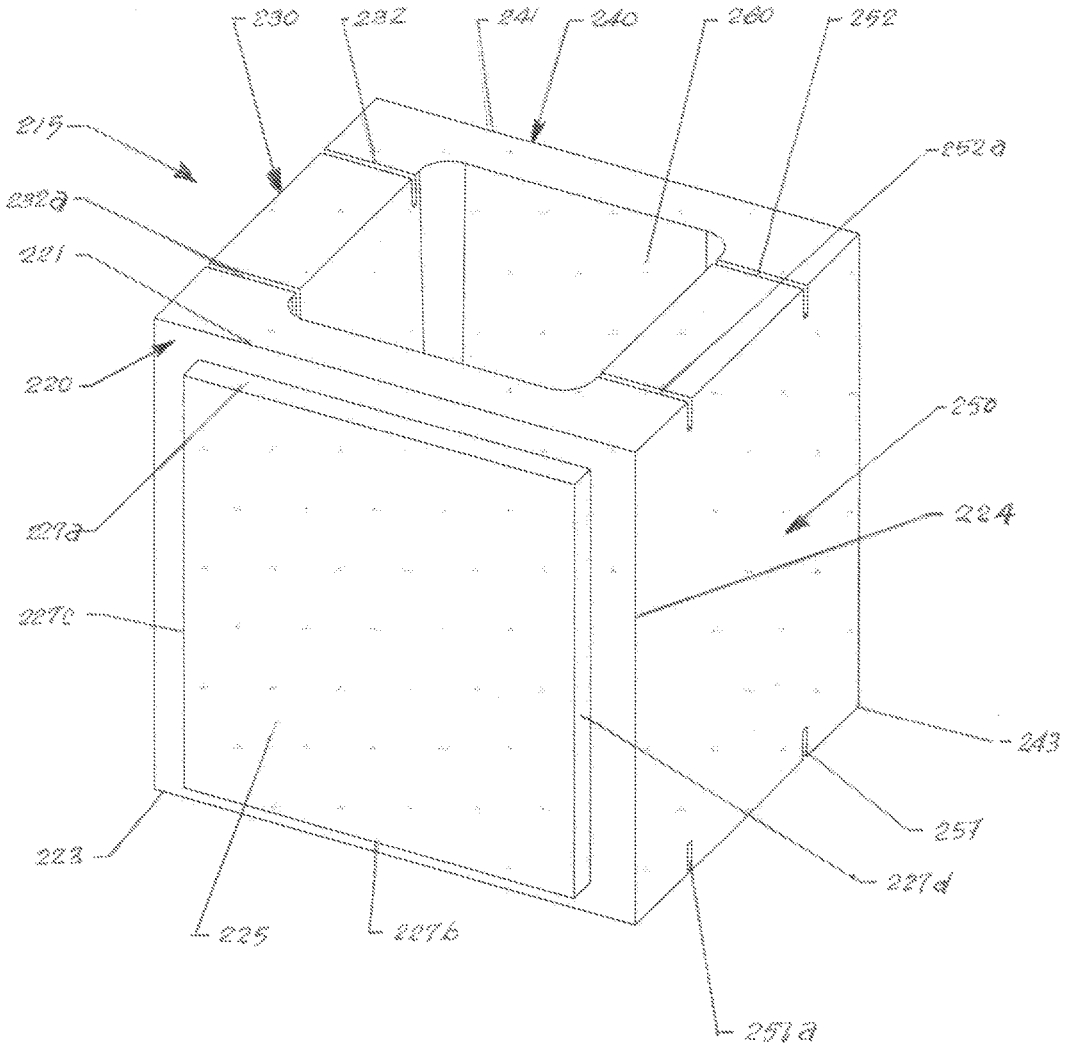
FIG. 3 is an isometric representation of one of the preferred embodiments for the primary half block.
Figure 3A:
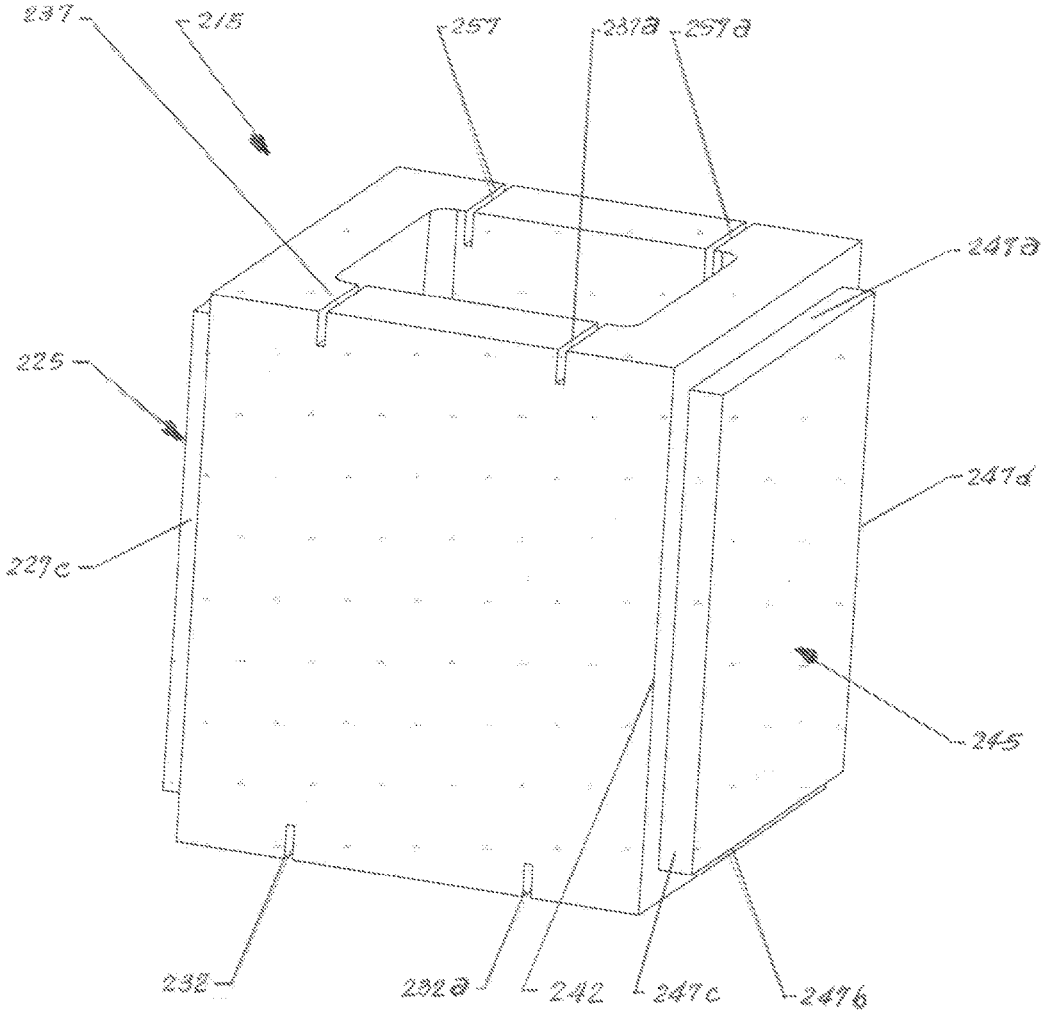
FIG. 3A is an isometric view of the primary half block in FIG. 3 as seen from below.

Primary half block 215, as seen in FIGS. 3 and 3A, is similar to primary block 15 except that its length is one half of the latter. Block 215 only has one cavity 260 defined by longitudinal walls 220 and 240 and transversal walls 230 and 250. Upper longitudinal edges 221 and 241 extend parallel with respect to each other and likewise lower longitudinal edges 223 and 224, along walls 220 and 240.

Rectangular wall 225 is mounted to, or extends from, wall 220 outwardly. Wall 225 is smaller than wall 220. Wall 225 includes peripheral edge walls 227*a*; 227*b*; 227*c* and 227*d* that are positioned inwardly a predetermined distance from edges 221; 222; 223 and 224, respectively. Similarly, rectangular wall 245 is mounted to or integrally extends from wall 240 outwardly. Wall 245 is smaller than wall 240 and includes peripheral edge walls 247*a*; 247*b*; 247*c* and 247*d* that are positioned inwardly a predetermined distance from edges 241; 242; 243 and 244, respectively.

As seen in FIG. 3, transversal walls 230 and 250 include upper channels 232; 232*a*; 252 and 252*a* and lower channels 237; 237*a*; 257 and 257*a*, respectively, that are aligned with each other and preferably positioned off center, at a predetermined distance from walls 220 and 240. This distance is preferably between 10% and 30% of the width of cavity 260. This separation prevents the interference of tools 80 and 180 with reinforcement bars or conduits (tubes) used in these structures. The width of channels 232; 232*a*; 252 and 252*a* is such that they snuggly receive guiding tools 80 and 180.

Figure 4:
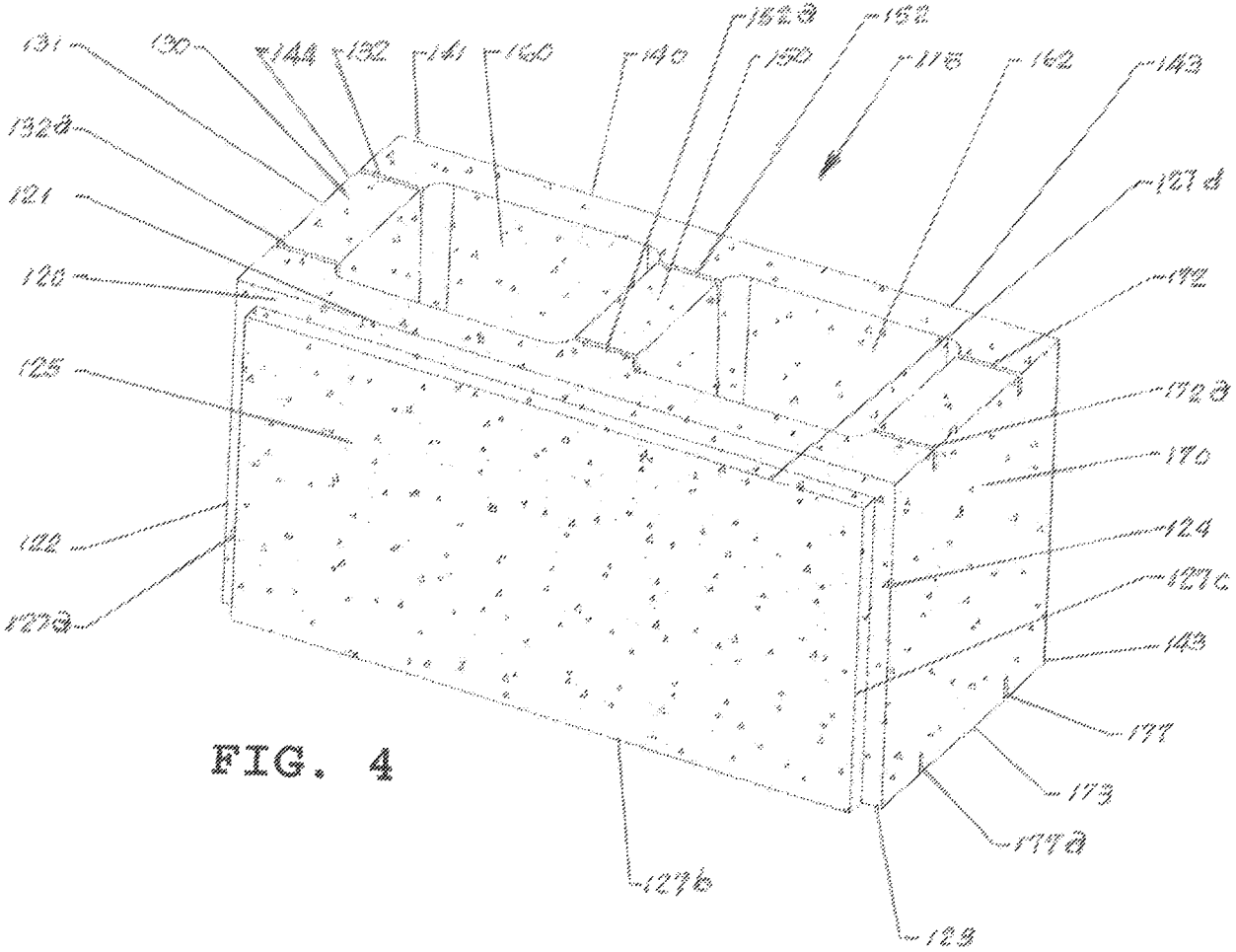
FIG. 4 is an isometric representation of one of the preferred embodiments for the base block.
Figure 4A:
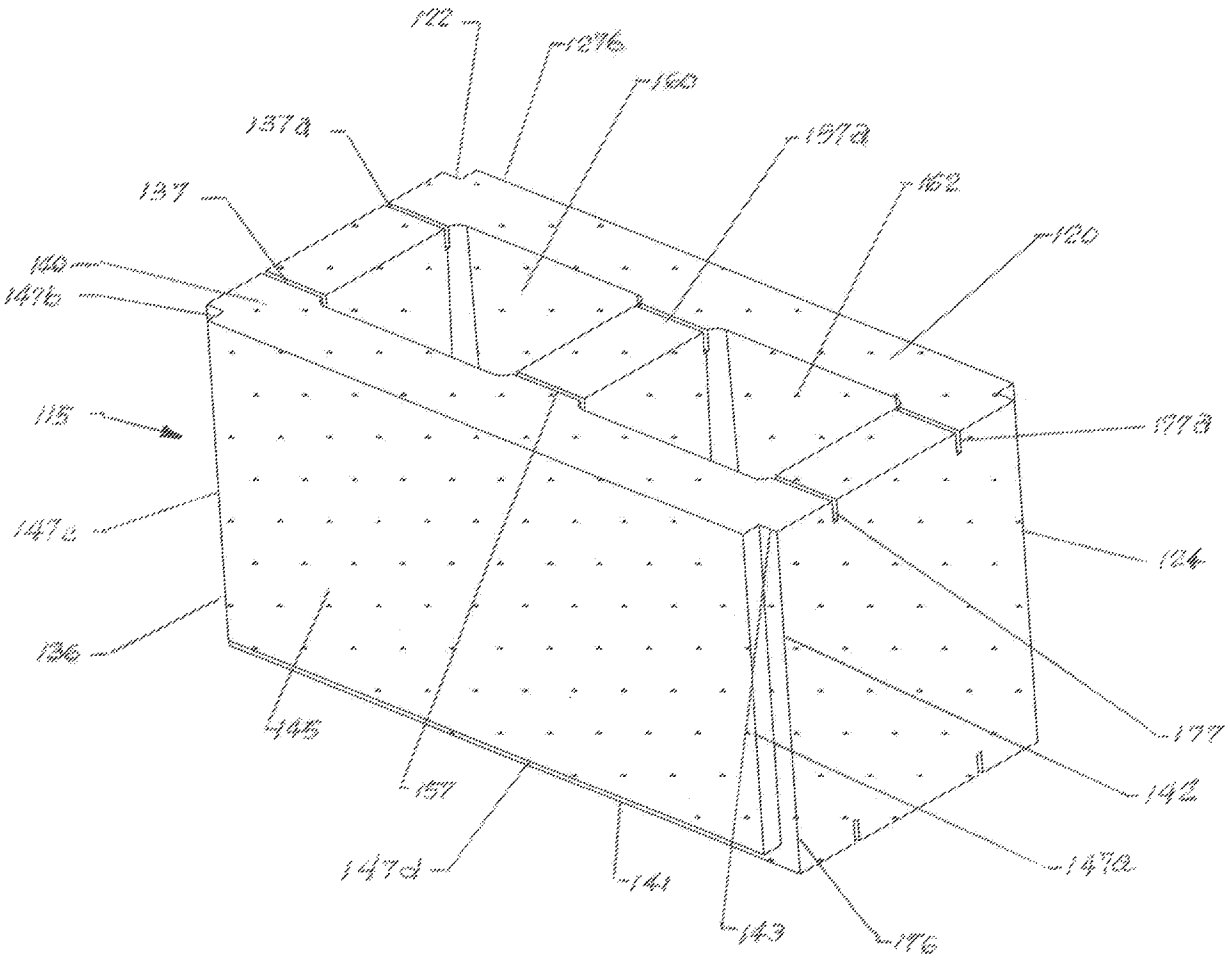
FIG. 4A is an isometric view of the base block in FIG. 4 as seen from below.

Base block 115, as best seen in FIGS. 4 and 4A, is similar to block 15 except that rectangular walls 125 and 145 extend all the way to the bottom of block 115 with peripheral wall 127*b* flush with lower edge 123. Block 115 has longitudinal walls 120; 140, transversal walls 130; 150 and 170. Longitudinal walls 120 and 140 are disposed at a parallel and spaced apart relationship with respect to each other and perpendicularly with respect to transversal walls 130; 150 and 170 defining internal cavity 160 (between walls 130 and 150) and internal cavity 162 (between walls 150 and 170). Block 115 also includes longitudinal upper edges 121 and 141 of longitudinal walls 120 and 140, respectively. Walls 120 and 140 include side edges 122 and 124 for wall 120, and side edges 136 and 176 for wall 140, that extend perpendicularly from upper edge 121 and lower edge 123, upper edge 141 and lower edge 143, respectively.

Rectangular wall 125 is mounted to, or integrally extends from, wall 120 outwardly. Wall 125 is smaller than wall 120 and includes peripheral edge walls 127*a*; 127*c* and 127*d* that are positioned inwardly a predetermined distance from edges 121; 122 and 124, respectively. Peripheral wall edge 127*b* is flush with lower edge 123.

Similarly, rectangular wall 145 is mounted to, or integrally extends from, wall 140 outwardly. Wall 145 is smaller than wall 140 and includes peripheral edge walls 147*a*; 147*c* and 147*d* that are positioned inwardly a predetermined distance from edges 141; 142 and 144. Peripheral edge wall 147*b* is flush with edge 122. Peripheral edge wall 147*b* is flush with edge 143.

As seen in FIG. 4, transversal walls 130; 150 and 170 include upper channels 132; 132*a*; 152; 152*a*; 172 and 172*a*, and lower channels 137; 137*a*; 157; 157*a*; 177 and 177*a*, respectively, that are aligned with each other and preferably positioned off center, at a predetermined distance from wall 120 or wall 140. This distance is preferably between 10% and 30% of the width of cavities 160 and 162 (which preferably have similar dimensions). This separation prevents the interference of tools 80 and 180 with reinforcement bars B or conduits and pipes used in these structures. The width of channels 132; 132*a*; 152 and 152*a* is such that they snuggly receive guiding tools 80 and 180.

Figure 5:
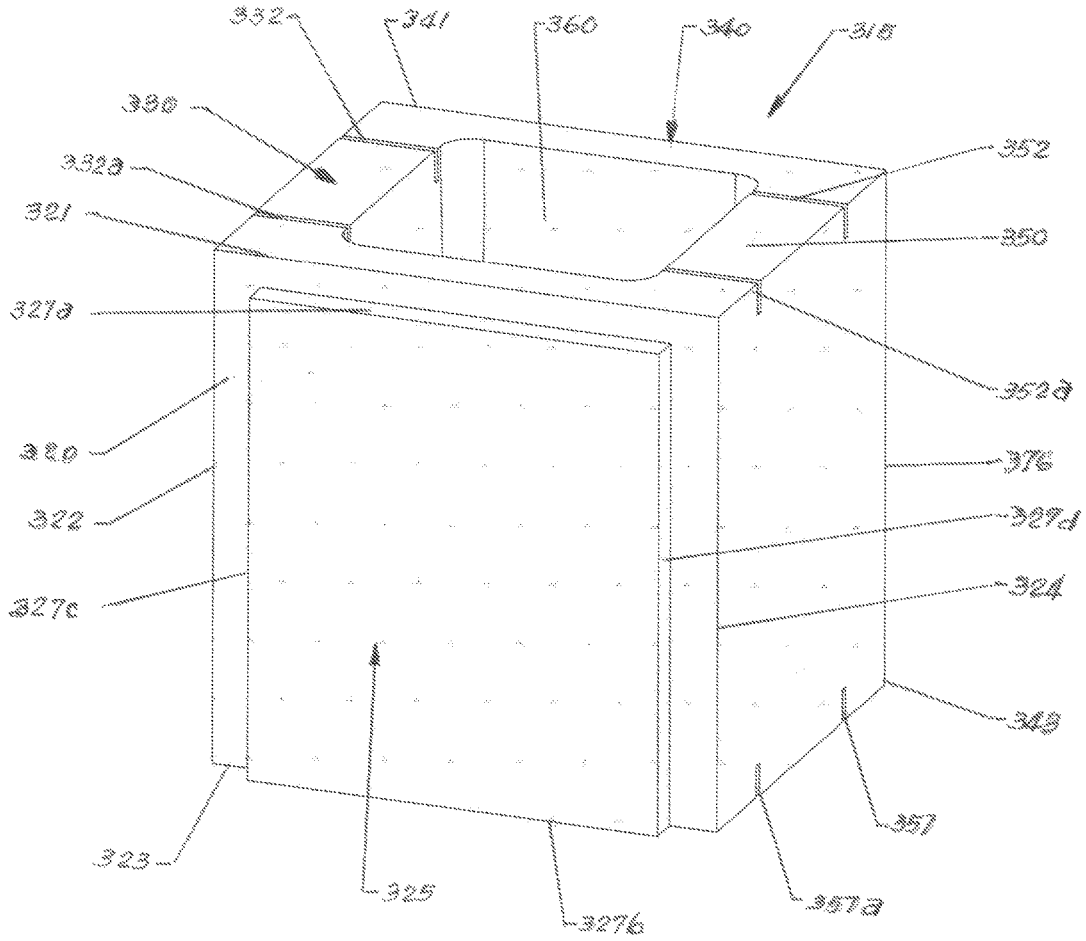
FIG. 5 is an isometric representation of one of the preferred embodiments for the construction base half block.
Figure 5A:
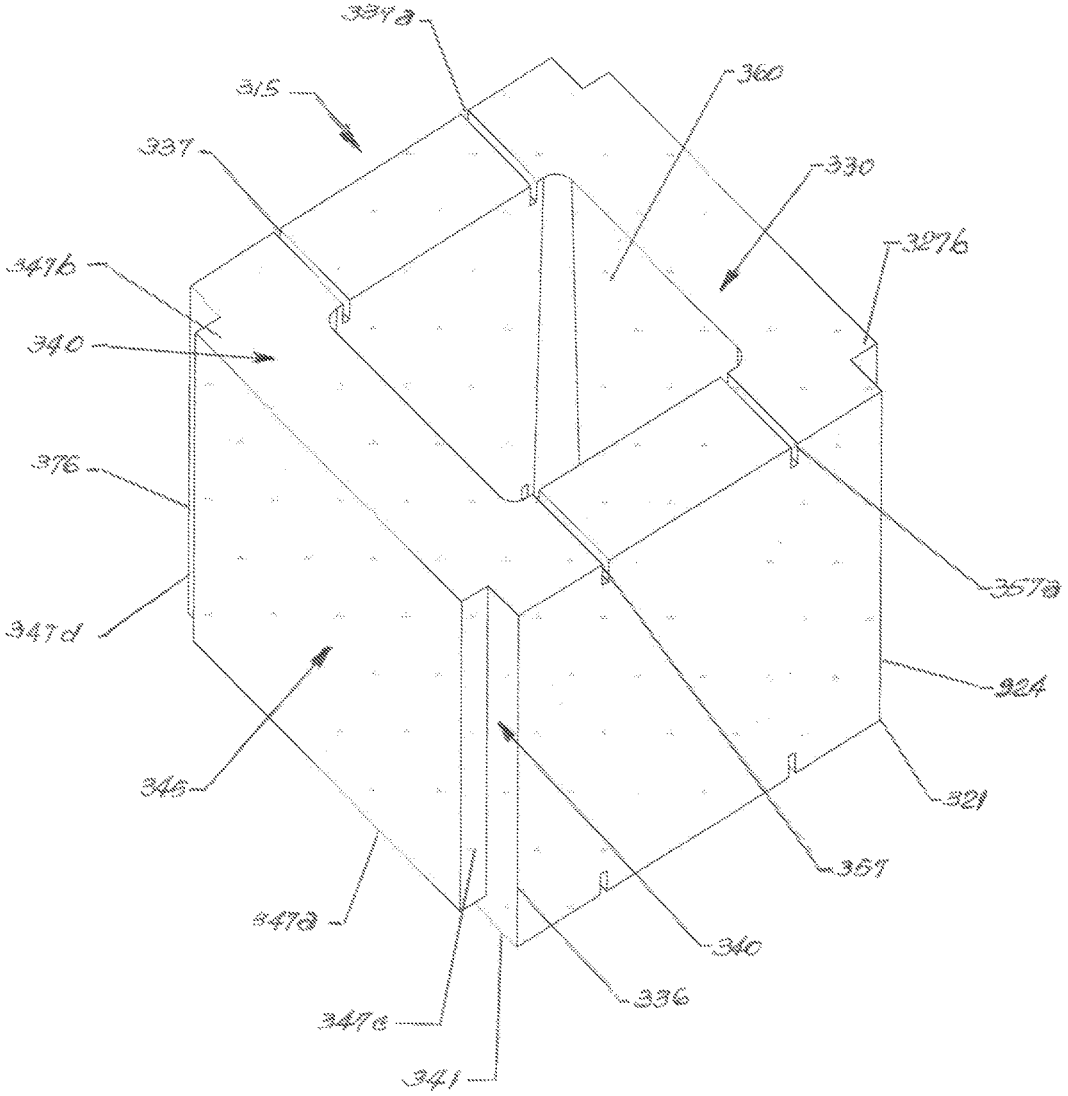
FIG. 5A is an isometric view of the base half block shown in FIG. 5 as seen from below.

Base half block 315, as seen in FIGS. 5 and 5A, is similar to base block 115 except that its length is one half of the latter. Block 315 has only one cavity 360 defined by longitudinal walls 320 and 340 and transversal walls 330 and 350. Upper longitudinal edges 321 and 341 extend parallel with respect to each other and likewise lower longitudinal edges 323 and 324, along walls 320 and 340.

Rectangular wall 325 is mounted to, or extends from, wall 320 outwardly. Wall 325 includes peripheral edge walls 327*a*; 327*b*; 327*c* and 327*d* that are positioned inwardly a predetermined distance from edges 321; 322; 323 and 324, respectively. Similarly, rectangular wall 345 is mounted to or integrally extends from wall 340 outwardly. Wall 345 is smaller than wall 340 and includes peripheral edge walls 347*a*; 347*b*; 347*c* and 347*d* that are positioned inwardly a predetermined distance from edges 341; 342; 343 and 344, respectively.

As seen in FIG. 5, transversal walls 330 and 350 include upper channels 332; 332*a*; 352 and 352*a* and lower channels 337; 337*a*; 357 and 357*a*, respectively, that are aligned with each other and preferably positioned off center, at a predetermined distance from walls 320 and 340. These distances are preferably between 10% and 30% of the width of cavity 360. This separation prevents the interference of tools 80 and 180 with reinforcement bars or conducts (pipes, etc) used in these structures. The width of channels 332; 332*a*; 352 and 352*a* is such that they snuggly receive guiding tools 80 and 180.

Figure 6:
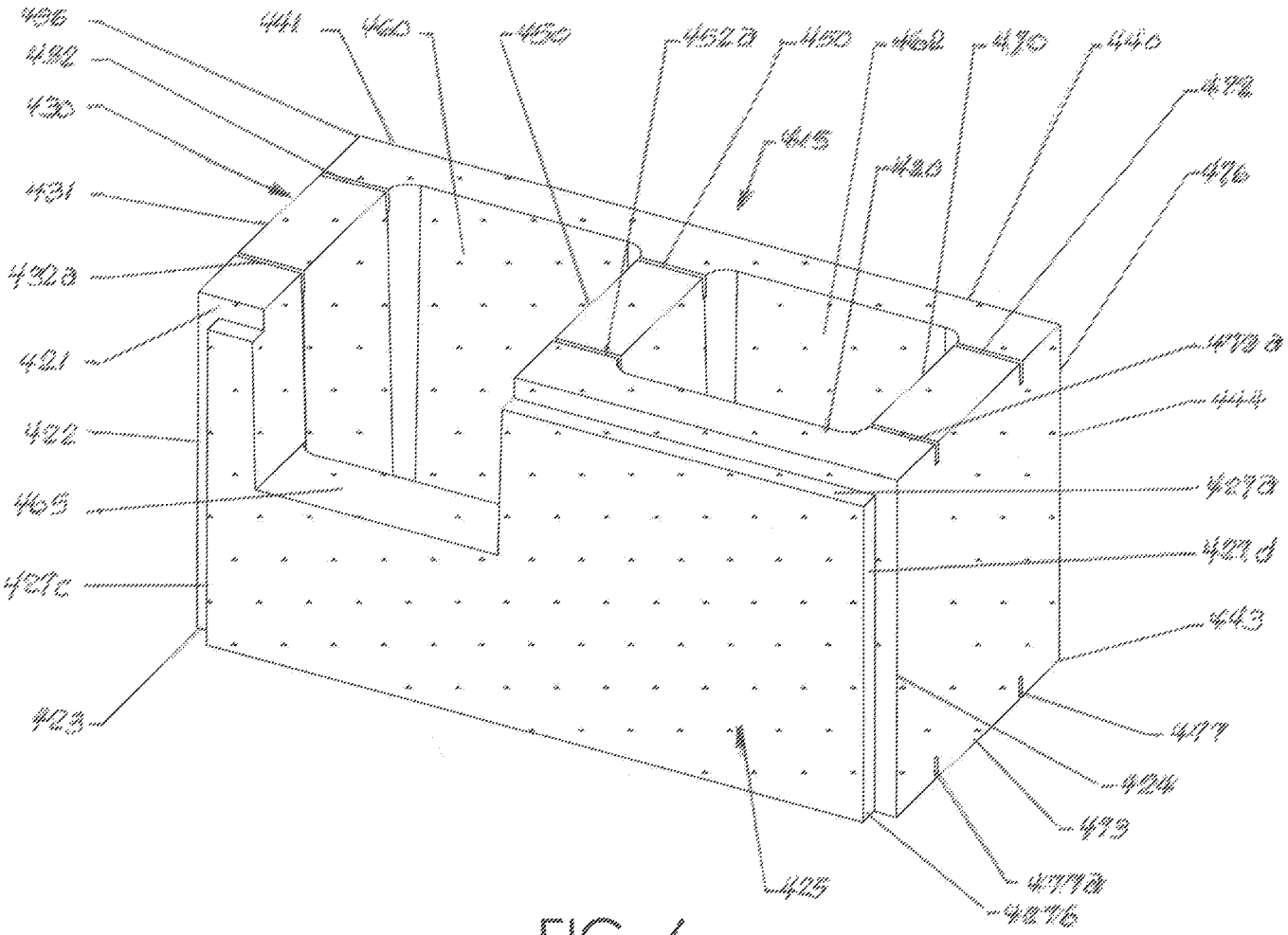
FIG. 6 is an isometric representation of one of the embodiments for the column base block.
Figure 6A:
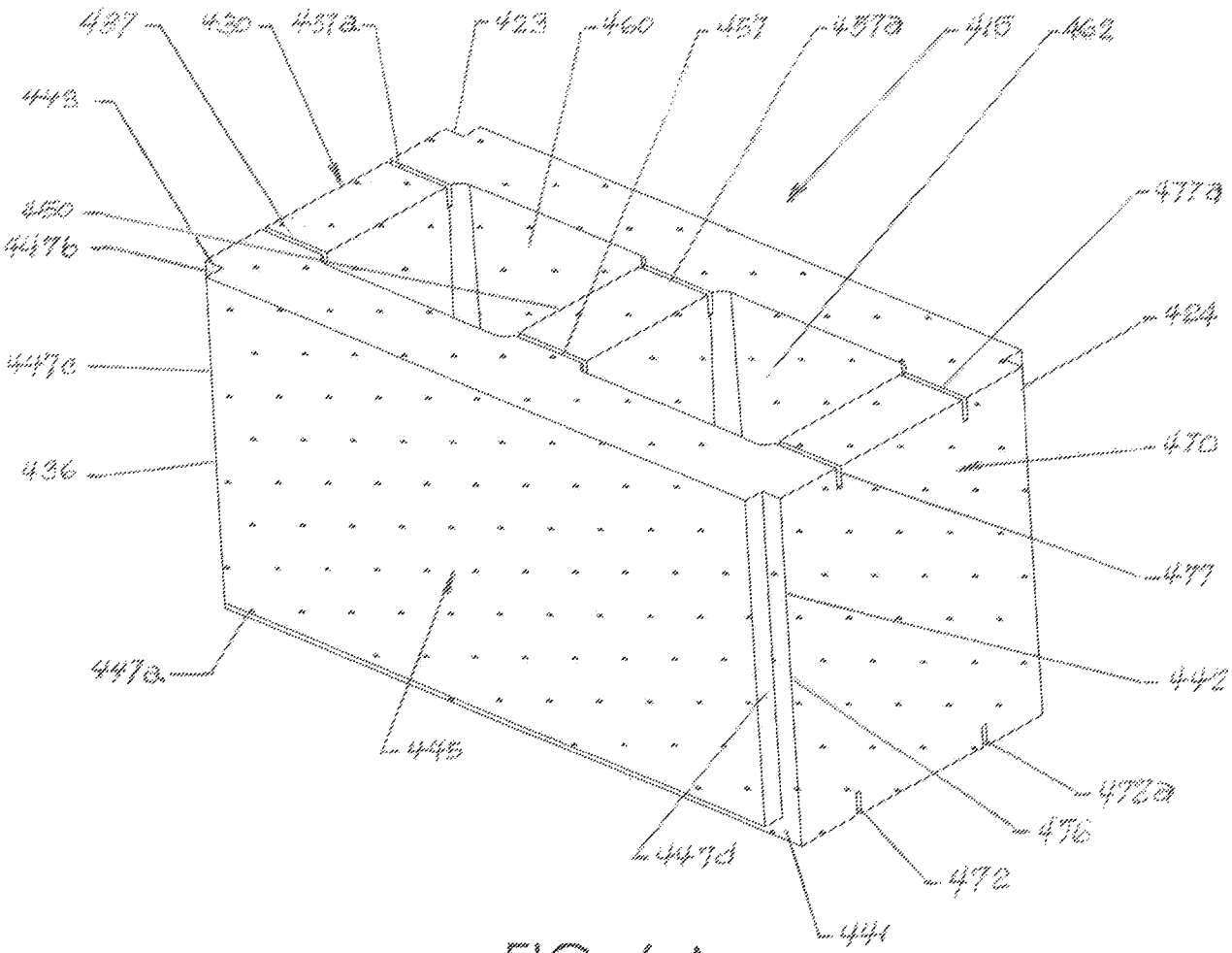
FIG. 6A is an isometric view of the column base block shown in FIG. 6 as seen from below.

As best seen in FIGS. 6 and 6A, base column block 415 includes longitudinal walls 420; 440, transversal walls 430; 450 and 470. Longitudinal walls 420 and 440 are disposed at a parallel and spaced apart relationship with respect to each other. They are perpendicularly with respect to transversal walls 430; 450 and 470. Walls 420; 430; 440; 450 and 470 define internal cavities 460 (between walls 430 and 470) and cavity 462 (between walls 450 and 470). Block 415 also include longitudinal upper edges 421 and 441 of longitudinal walls 420 and 440, respectively. Walls 420 and 440 include side edges 422 and 424 for wall 420 and side edges 436 and 476 for wall 440 that extend perpendicularly from upper edge 421 and lower edge 443, respectively.

Block 415 also includes column cutout 465 connected with cavity 460, as shown in FIG. 6. This permits to inspection of iron bars B in formed columns before pouring concrete.

Rectangular wall 425 is mounted, or extends from, wall 420 outwardly. Wall 425 is smaller than wall 420. Wall 425 includes peripheral edge walls 427*a*; 427*c* and 427*d* that are positioned inwardly a predetermined distance from edges 421; 422 and 424, respectively. Peripheral edge wall 427*b* is flush with edge 423. Similarly, rectangular wall 445 is mounted to or integrally extends from wall 440 outwardly. Wall 445 is smaller that wall 440 and includes peripheral edge walls 447*a*; 447*c* and 447*d* that are positioned inwardly a predetermined distance from edges 441; 442; and 444. Peripheral edge wall 447*b* is flush with edge 443.

As seen in FIG. 6, transversal walls 430; 450 and 470 include upper channels 432; 432*a*; 452; 452*a*; 472 and 472*a*, and lower channels 437; 437*a*; 457; 457*a*; 477 and 477*a*, respectively, that are aligned with each other and preferably positioned off center, at a predetermined distance from wall 420 or wall 440. This distance is preferably between 10% and 30% of the width of cavities 460 and 462 (which preferably have similar dimensions). This separation prevents the interference of tools 80 and 180 with reinforcement bars B or conduits and pipes used in these structures. The width of the upper and lower channels is such that they snuggly receive guiding tools 80 and 180.

Figure 7:
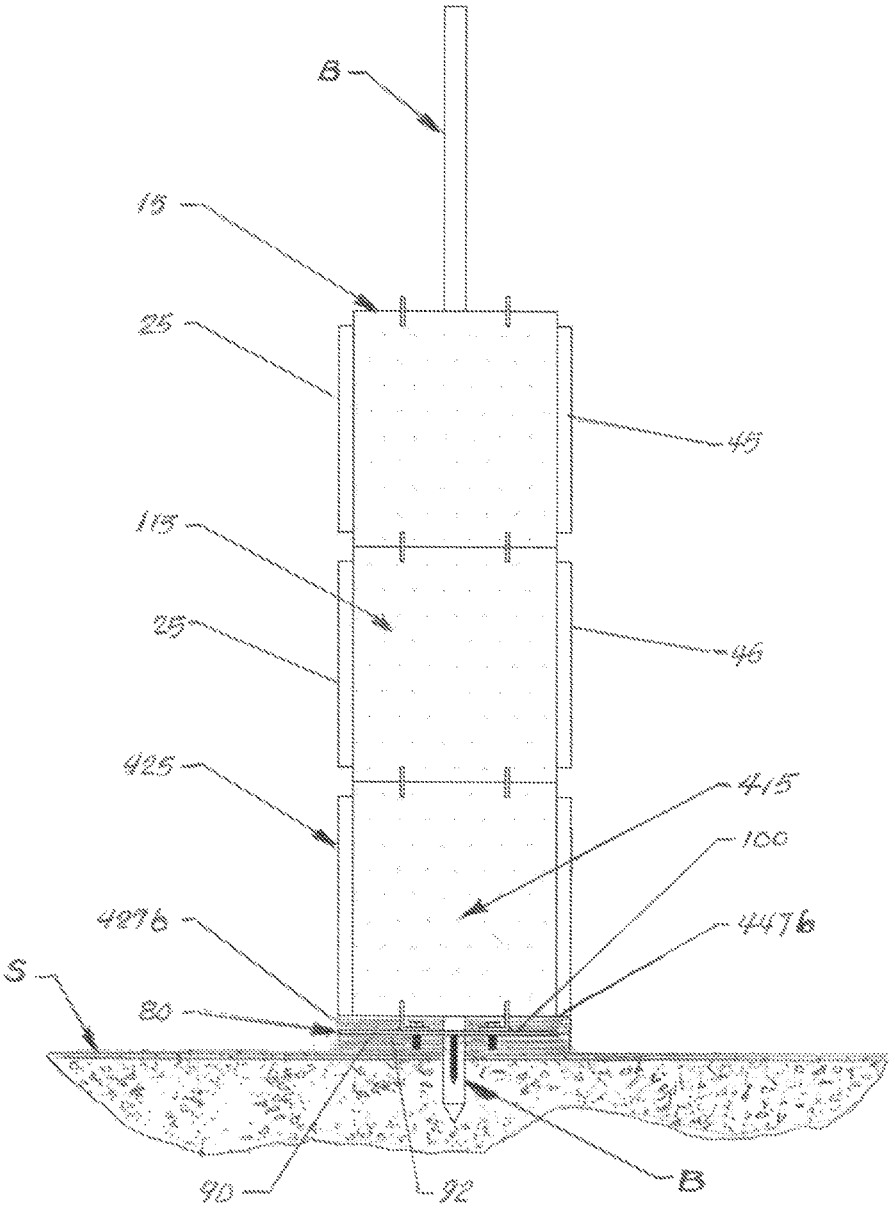
FIG. 7 is an elevational cross-sectional view of the construction block system including three contiguous abutting block rows along section 7-7' in FIG. 1 and also showing the cementitious substance added at the base as well as the aligning and leveling tool 80.
Figure 8:
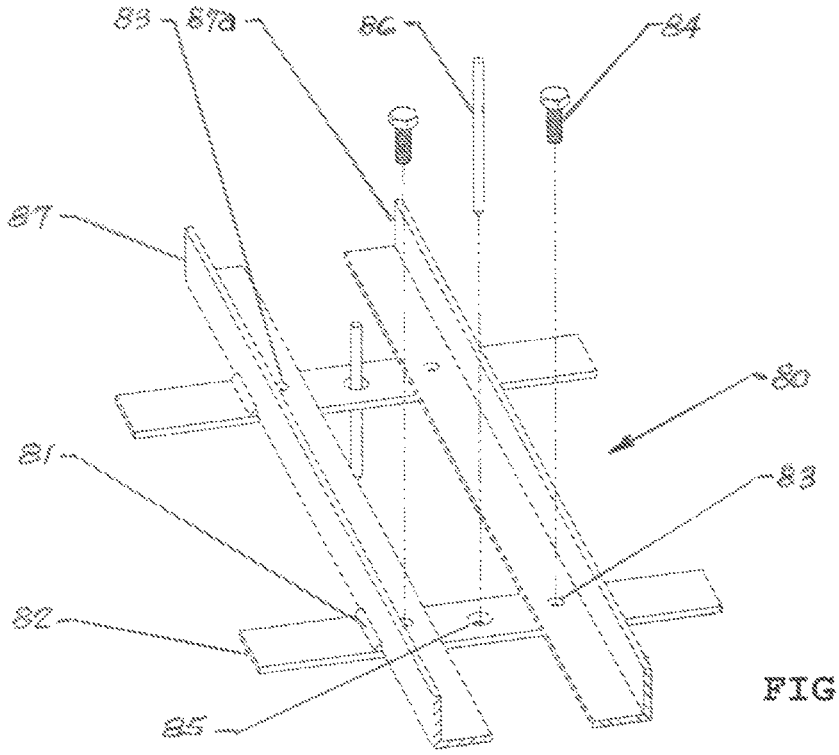
FIG. 8 illustrates an isometric view of the base alignment tool used in construction block system 10 represented in FIG. 1 using a location pin or nail.

In FIG. 7 a cross-section along line 7-7' in FIG. 1 is shown. Three rows of blocks are shown. The lowermost block corresponds to column block 415. It can be seen that these is a layer of a cementitious substance 100 between supporting surface S and the bottom surfaces of walls 420 and 440, as well as peripheral edge walls 427*b* and 447*b* of column base block 415. Base leveling and alignment tool 80 is also resting on surface S through transversal members 82 that include threaded holes 83 that mate with leveling bolts 84 as seen in FIGS. 8; 8A; 9 and 9A. Threaded holes 83 are kept at a predetermined spaced apart relationship with respect to each other. Through opening 85 is preferably located at the center of transversal members 82 and cooperatively receives therethrough a location pin or nail 86 that penetrates in the supporting surface S keep tool 80 in place. Rails 87; 87*a* are preferably implemented with L-beams. Guiding rails 87; 87*a* are mounted perpendicularly on transversal members 82 and are cooperatively received within channels 137; 137*a*; 157; 157*a*; 177 and 177*a* of base block 115; channels 337; 337*a*; 357 and 357*a* of base half block 315, channels 437; 437*a*; 457; 457*a*; 477 and 477*a* of column block 415. This permits an accurate alignment of the blocks.

Figure 8A:
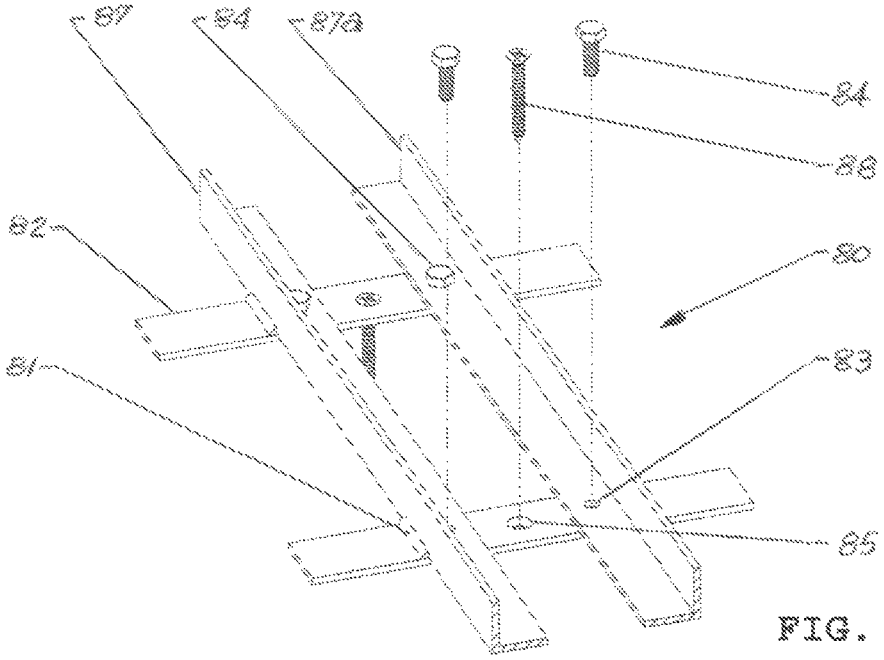
FIG. 8A shows an isometric view of the base alignment and leveling tool used in construction block system 10 represented in FIG. 1 with location screw to be installed thereby keeping the horizontal alignment and also the level bolts of the wall structure.
Figure 9:
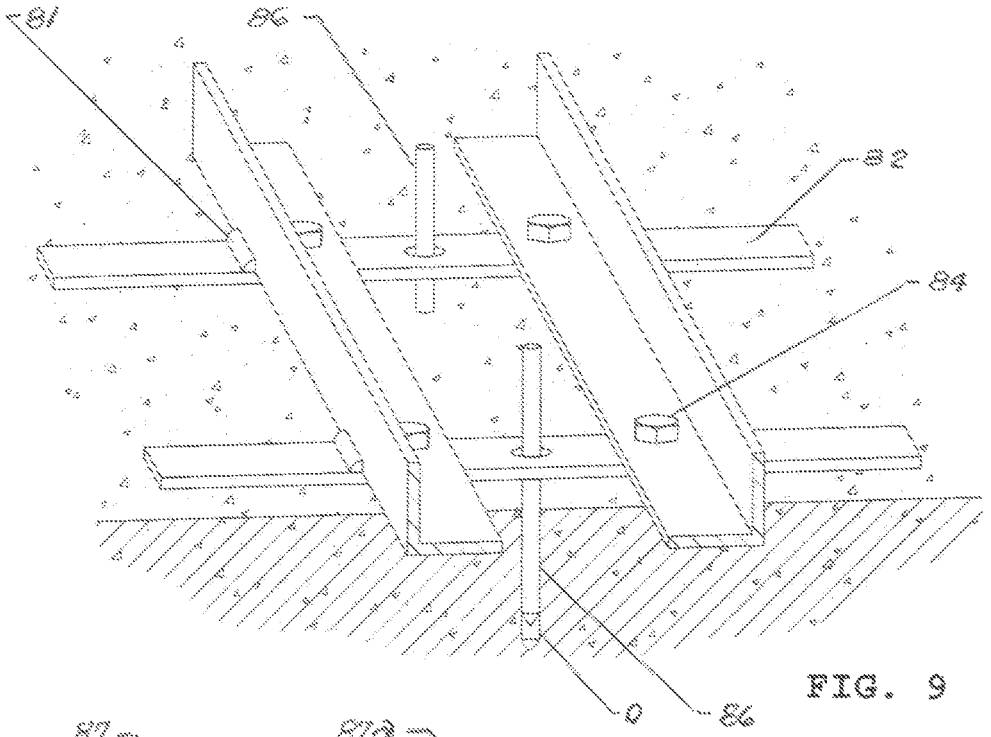
FIG. 9 illustrates an isometric view of the base alignment and leveling tool used in the construction block system mounted on a concrete surface using location pins to locate the position where the positive screw will be subsequently installed.
Figure 9A:
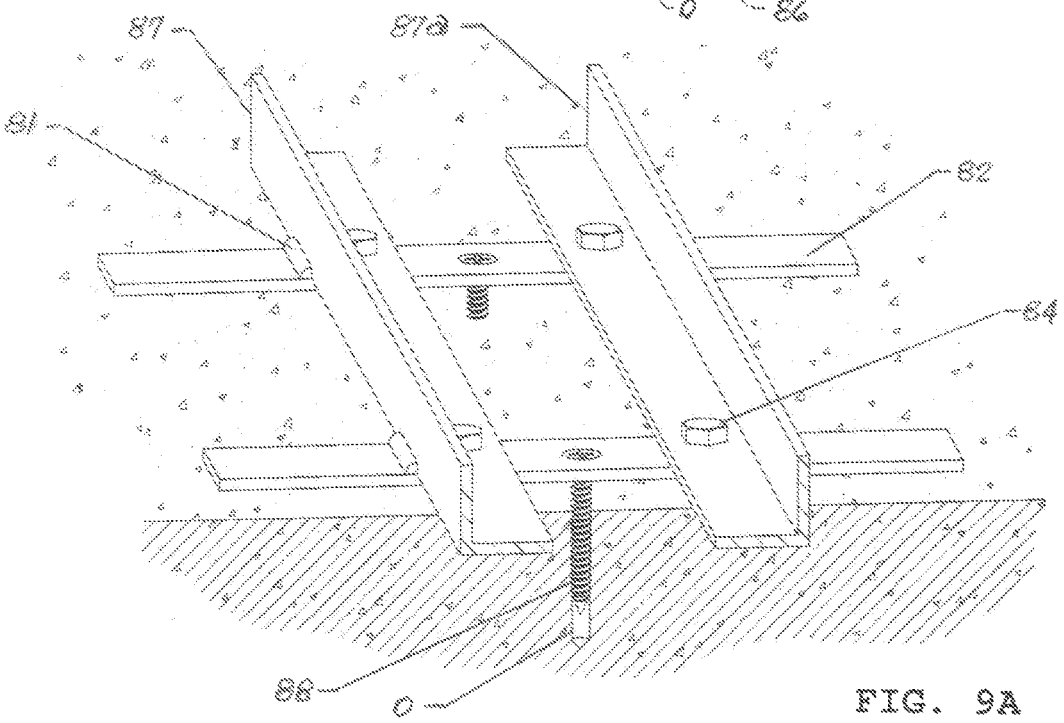
FIG. 9A illustrates an isometric view of the base alignment and leveling tool used in the construction block system mounted on a concrete surface using location screws to permanently mount the tool.
Figure 10:
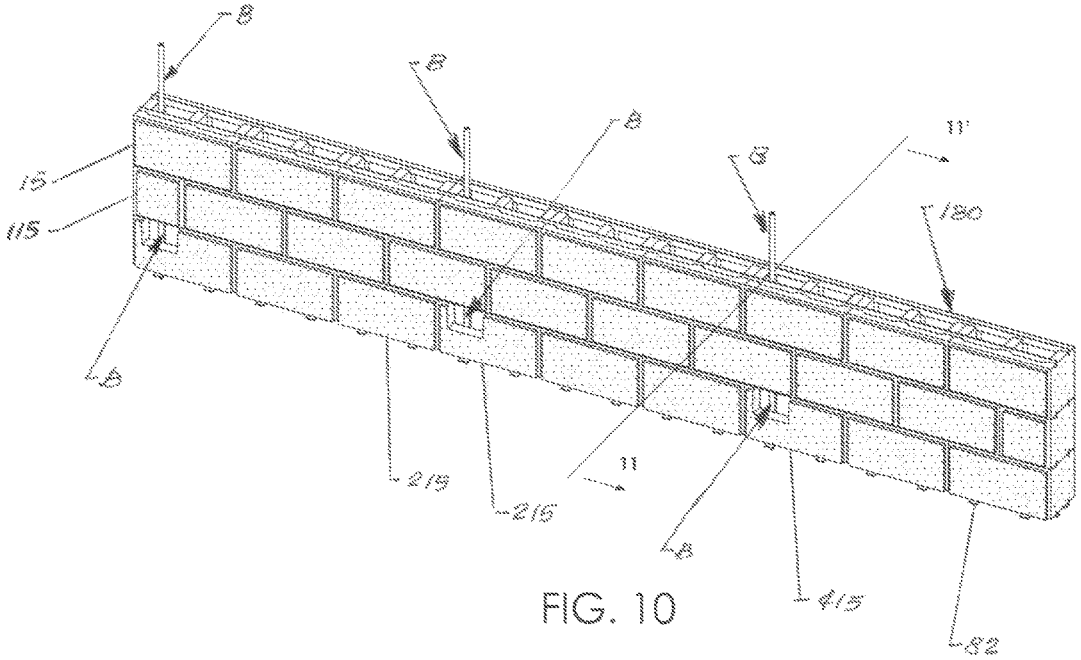
FIG. 10 shows an isometric view of a wall structure with three rows built using the present invention using base column blocks, base blocks, primary blocks and primary half blocks.
Figure 11:
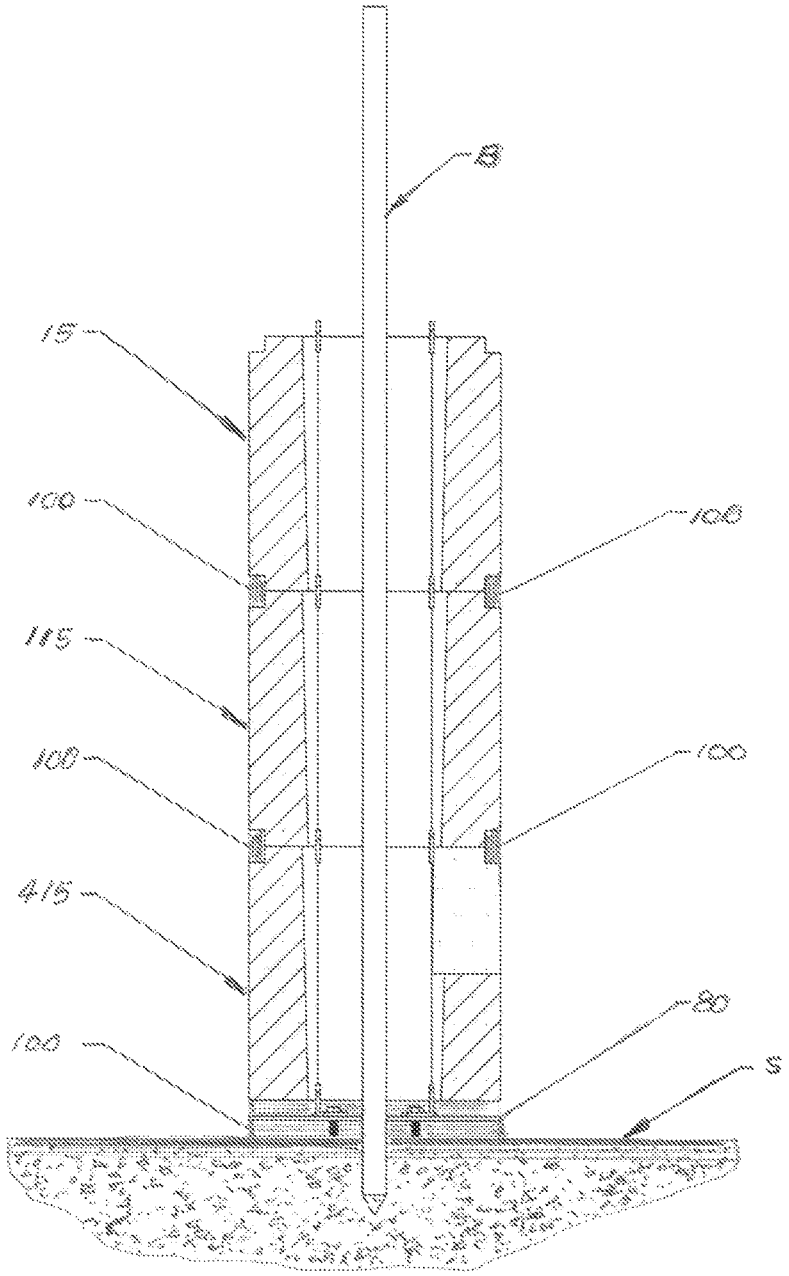
FIG. 11 is an elevational cross-sectional view taken along section 11-11' in FIG. 10.

As shown in FIGS. 8 and 8A, base leveling and alignment tool 80 permits a user to level and align the first row of base blocks 115; 315 and column blocks 415. Tool 80 includes transversal members 82 with guiding rails 87; 87*a* that are preferably soldered to members 82 at location 81. Rails 87; 87*a* extend at a predetermined apart spaced relationship with respect to each other. To install tool 80, a user lays out a trach or portion that includes several transversal members 82 along a predetermined path as best seen in FIG. 8. Once positioned, a user passes locating nail 86 through opening 85 and penetrates supporting surface S a predetermined distance to create a base to be subsequently partially filled with location screw 88. Transversal members 82 include two threaded holes 83, spaced apart, and cooperate to receive mating leveling bolts 84. The distal end of bolts 84 comes in contact with supporting surface S to level tool 80. Location headed screw 88 is then passed through opening 85 and into the base created by locating nail 86. The distal threaded end of screw 88 penetrates inside the bore and the head of screw 88 coacts with transversal members 82 thereby securing tool 80 in place along the horizontal plane, as seen in FIG. 8A. As it can be seen in FIG. 7 cementitious substance 100 is placed under the base blocks also above and below tool 80.

Row alignment and leveling tool 90 includes an elongated rigid flat member 92 that is cooperatively received within channels 32; 32*a*; 52; 52*a*; 72; 72*a*; 132; 132*a*; 152; 152*a*; 172; 172*a*; 232; 232*a*; 252; 252*a*; 332; 332*a*; 352; 352*a*; 432; 432*a*; 452; 452*a*; 472 and 472*a*. This permits the alignment subsequent rows of blocks as well as reinforcement of the resulting structure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A construction block system comprising:

A) a plurality of primary blocks each having first and second longitudinal walls with upper and lower surfaces and kept at parallel and spaced apart relationship with respect to each other and further including first, second and third transversal walls each having upper and lower surfaces and extending perpendicularly to said first and second longitudinal walls to define first and second cavities, and each of said first and second longitudinal walls including first and second rectangular walls, respectively, extending outwardly and having smaller dimensions than said first and second longitudinal walls thereby defining first, second, third and fourth peripheral edge walls perpendicular to said first and second longitudinal walls and each of said first, second and third transversal walls upper and lower surfaces further including each a pair of aligned channels and said primary blocks abuttingly coacting with each other to form a structure;

B) a plurality of primary half blocks each having third and fourth longitudinal walls kept at a parallel and spaced apart relationship with respect to each other and fourth and fifth transversal walls extending perpendicularly to said third and fourth longitudinal walls defining a third cavity and each of said third and fourth longitudinal walls including third and fourth rectangular walls, respectively, extending outwardly and having smaller dimensions than said third and fourth longitudinal walls thereby defining fifth, sixth, seventh and eighth peripheral edge walls perpendicular to said third and fourth longitudinal walls, each of said fourth and fifth transversal walls having upper and lower surfaces that include a pair of aligned channels each and said primary half blocks coacting with said primary blocks to complement said structure;

C) at least one base alignment and leveling tool that includes two rails mounted on a plurality of transversal members walls and said rails kept at a parallel and spaced apart relationship with respect to each other, said rails being cooperatively received by said channels of said transversal walls lower surfaces resting on a supporting substantially horizontal surface, said transversal members include a centrally located through hole for cooperatively receiving a location fastening member that passes through penetrating and engaging said supporting surface and said transversal members thereby securing said base alignment and leveling tool at a predetermined location, said transversal members further including at least two threaded openings and corresponding leveling bolts that are matingly passed therethrough to coact with the supporting surface to level said base alignment and leveling tool and the abutting primary and primary half blocks.

2. The construction block system set forth in claim 1 further including:

D) at least one alignment tool having an elongated flat shape that is cooperatively received within said channels to ensure the alignment of the rows of said primary and primary half blocks in said structure and to further strengthen said structure.

3. A construction block system comprising:

A) a plurality of primary blocks each having first and second longitudinal walls with upper and lower surfaces and kept at parallel and spaced apart relationship with respect to each other and further including first, second and third transversal walls each having upper and lower surfaces and extending perpendicularly to said first and second longitudinal walls to define first and second cavities, and each of said first and second longitudinal walls including first and second rectangular walls, respectively, extending outwardly and having smaller dimensions than said first and second longitudinal walls thereby defining first, second, third and fourth peripheral edge walls perpendicular to said first and second longitudinal walls and each of said first, second and third transversal walls upper and lower surfaces further including each a pair of aligned channels and said primary blocks abuttingly coacting with each other to form a structure;

B) a plurality of primary half blocks each having third and fourth longitudinal walls kept at a parallel and spaced apart relationship with respect to each other and fourth and fifth transversal walls extending perpendicularly to said third and fourth longitudinal walls defining a third cavity and each of said third and fourth longitudinal walls including third and fourth rectangular walls, respectively, extending outwardly and having smaller dimensions than said third and fourth longitudinal walls thereby defining fifth, sixth, seventh and eighth peripheral edge walls perpendicular to said third and fourth longitudinal walls, each of said fourth and fifth transversal walls having upper surfaces that include a pair of aligned channels each and said primary half blocks coacting with said primary blocks to complement said structure;

C) a plurality of base blocks each having fifth and sixth longitudinal walls with upper and lower surfaces and kept at a predetermined spaced apart relationship with each other and further including sixth, seventh and eight transversal walls, with upper and lower surfaces, and extending perpendicularly between said fifth and sixth longitudinal walls to define fourth and fifth cavities, each of said fifth and sixth longitudinal walls including fifth and sixth rectangular walls, respectively, extending outwardly and having smaller dimensions than said fifth and sixth longitudinal walls thereby defining ninth, tenth, eleventh and twelfth peripheral edge walls extending perpendicularly from said fifth and sixth longitudinal walls, with said ninth peripheral edge walls being flush with the lower surfaces of said fifth and sixth longitudinal walls and each of said sixth, seventh and eight transversal walls' upper and lower surfaces further including each a pair of aligned channels and each of said base blocks coacting with said primary and said primary half blocks to complement said structure; and D) at least one base alignment and leveling tool that includes two rails mounted on a plurality of transversal sixth, seventh and eight walls and said rails kept at a parallel and spaced apart relationship with respect to each other, said rails being cooperatively received by said channels of said transversal members lower surfaces resting on a supporting substantially horizontal surface, said transversal members include a centrally located through hole for cooperatively receiving a location fastening member that passes through penetrating and engaging said supporting surface and said transversal members thereby securing said base alignment and leveling tool at a predetermined location, said transversal members further including at least two threaded openings and corresponding leveling bolts that are matingly passed therethrough to coact with the supporting surface to level said base alignment and leveling tool and the abutting base blocks.

4. The construction block system set forth in claim 3 further including:

F) a plurality of base half block each having seventh and eight longitudinal walls with upper and lower surfaces and kept a predetermined spaced art relationship with respect to each other and further including ninth and tenth transversal walls with upper and lower surfaces and extending perpendicularly to said seventh and eight longitudinal walls to define a sixth cavity, each of said seventh and eight longitudinal walls including seventh and eight rectangular walls, respectively, extending outwardly and having smaller dimensions than said seventh and eight longitudinal walls thereby defining thirteenth, fourteenth, fifteenth and sixteenth peripheral edges walls extending perpendicularly from said seventh and eighth longitudinal walls, with said thirteenth peripheral edge walls being flush with said lower surfaces of said seventh and eight longitudinal walls and each of said ninth and tenth transversal walls' upper and lower surfaces further including each a pair of aligned channels and said base half blocks resting on said base alignment and leveling tool coacting with each other and said base blocks to complement said structure.

5. The construction block set forth in claim 4 further including:

G) a plurality of base column blocks each having ninth and tenth longitudinal walls, with upper and lower surfaces, and kept at a predetermined spaced apart relationship with respect to each other said ninth longitudinal wall including a cutout and further including eleventh, twelfth and thirteenth transversal walls, with upper and lower surfaces, and extending perpendicularly between said ninth and tenth longitudinal walls to define seventh and eight cavities and said seventh cavity being connected to said cutout, each of said ninth and tenth longitudinal walls including ninth and tenth rectangular walls, respectively, extending outwardly and having smaller dimensions than said ninth and tenth longitudinal walls thereby defining seventeenth, eighteenth, nineteenth and twentieth peripheral edge walls extending perpendicularly from said ninth and tenth longitudinal walls with said ninth peripheral edge walls being flush with the lower surfaces of said ninth and tenth longitudinal walls and each of said eleventh, twelfth and thirteenth transversal walls' upper and lower surfaces further including each a pair of aligned channels and said base column blocks resting on said base alignment and leveling tool coacting with abutting d base blocks and sa base half blocks to complement said structure.

* * * * *